United States Patent [19]

Brodell

[11] 4,131,388

[45] Dec. 26, 1978

[54] OUTER AIR SEAL

[75] Inventor: Robert F. Brodell, Glastonbury, Conn.

[73] Assignee: United Technologies Corporation, Hartford, Conn.

[21] Appl. No.: 800,979

[22] Filed: May 26, 1977

[51] Int. Cl.[2] ..... F01D 11/08; F01D 25/24; F02C 7/20

[52] U.S. Cl. ..... 415/138; 415/170 R; 415/217; 60/39.32

[58] Field of Search ..... 415/136, 138, 170 R, 415/217, 218, 139; 60/39.32

[56] References Cited

U.S. PATENT DOCUMENTS

| | | | |
|---|---|---|---|
| 2,494,178 | 1/1950 | Imbert | 415/136 |
| 2,638,743 | 5/1953 | Feilden | 415/217 X |
| 3,425,665 | 2/1969 | Lingwood | 415/134 X |

FOREIGN PATENT DOCUMENTS

| | | | |
|---|---|---|---|
| 954835 | 12/1956 | Fed. Rep. of Germany | 415/172 A |
| 689270 | 3/1953 | United Kingdom | 415/217 |

*Primary Examiner*—William L. Freeh
*Assistant Examiner*—Donald S. Holland
*Attorney, Agent, or Firm*—Robert C. Walker

[57] ABSTRACT

An outer air seal circumscribing the tips of the rotor blades of a rotary machine is disclosed. Techniques for limiting the radial clearance between the tips of the blades and the outer air seal at steady state conditions are developed. Structure independent of the machine case for isolating the thermal response of the outer air seal from the thermal response of the machine case is discussed and illustrated.

9 Claims, 2 Drawing Figures

FIG. 1
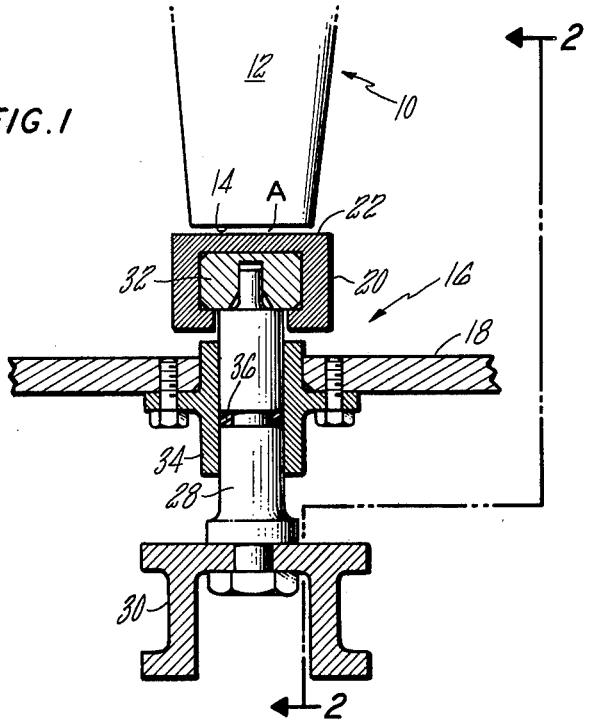
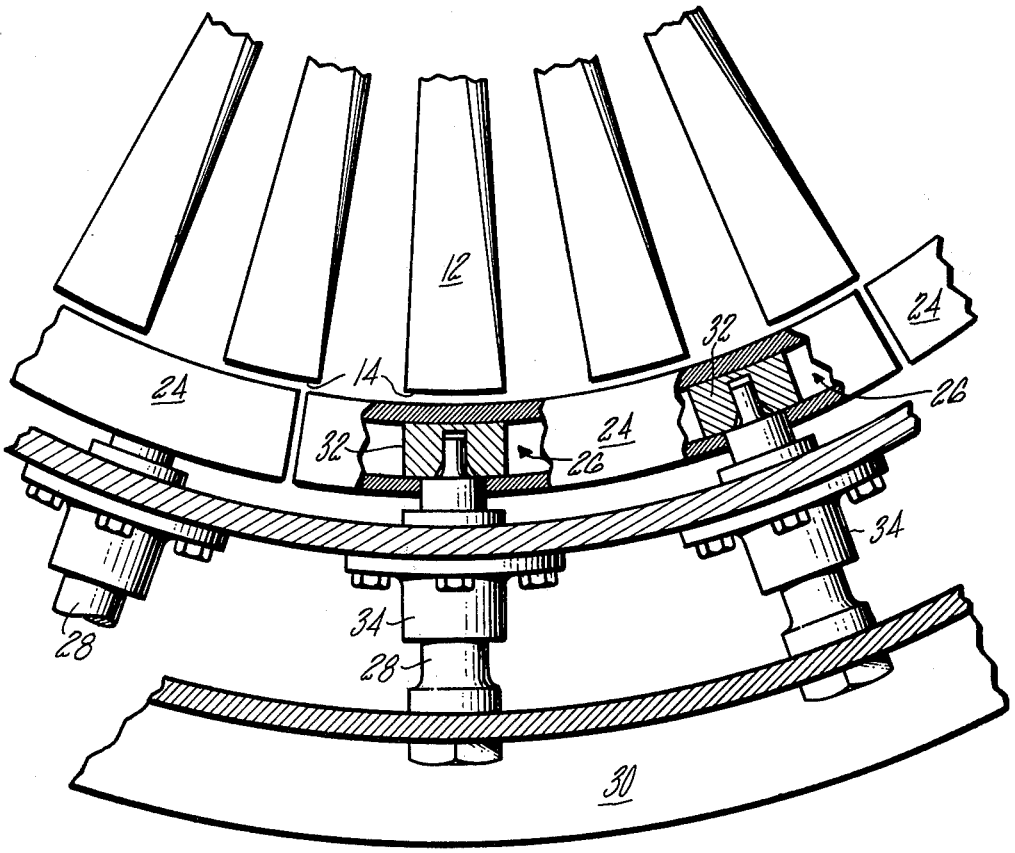
FIG. 2

OUTER AIR SEAL

BACKGROUND OF THE INVENTION

1. Field of the Invention

This invention relates to axial flow rotary machines, and more particularly to outer air seals circumscribing the blade tips of a rotor stage.

2. Description of the Prior Art

Gas turbine engines are illustrative of rotary machines in which the inventive concepts may be employed. In a gas turbine engine working medium gases are compressed by a first series of rotor mounted blades in the compression section and are flowed axially downstream to a combustion section. Fuel is combined with the compressed gases and burned in the combustion section to add thermal energy to the flowing medium. Downstream of the combustion section the gases are flowed across a second series of rotor mounted blades in the turbine section. Energy extracted from the medium by the second series of rotor blades is utilized to drive the blades of the compression section. The blades of both the compression and turbine sections are arranged in stages, or rows. The tips of the blades in each row are circumscribed by an outer air seal.

Aerodynamic performance within the engine is largely dependent upon the radial clearance between the outer air seal and the circumscribed blade tips. Even the slightest clearance degrades performance as the working medium gases escape over the tips of the blades. The problem is particularly severe in high temperature machines having radical thermal fluctuations over the operating range of the machine. The blades of the rotor respond immediately to changes in the temperature of the working medium gases. The conventional outer air seal responds much more slowly to these changes. Substantial initial clearances are provided between the tips of the rotor blades and the outer air seals to protect the respective structures from destructive interference during transient thermal conditions.

As the machine reaches thermal equilibrium the outer air seals tend to grow away from the rotor blade tips to a clearance which is on the same order of magnitude as the initial clearance discussed above. Past efforts for reducing clearances have primarily included elaborate case cooling systems for reducing the steady state temperature of the structure supporting the outer air seal. Reducing the temperature of the supporting structure limits the outward radial growth of the seal beyond the diameter required for transient clearance. An effective reduction in tip clearance results, although not without a substantial diversion of the working medium gases for case cooling. U.S. Pat. No. 3,583,824 to Smuland et al entitled "Temperature Controlled Shroud and Shroud Support" is representative of outer air seal structures employing cooling techniques.

Other approaches to reduced seal clearance include that shown in U.S. Pat. No. 2,488,875 to Morley entitled "Gas Turbine Engine". In Morley the vanes of the stator stage engage an inner case structure at a spigot and socket arrangement. The outer air seals extend axially from the stator vanes to circumscribe the tips of the rotor blades.

Although solutions proposed in the past for reducing blade tip clearance have been partially successful, scientists and engineers in the gas turbine art are continuing to search for structures offering improved engine performance.

SUMMARY OF THE INVENTION

A primary object of the present invention is to improve the aerodynamic efficiency of an axial flow rotary machine, such as a gas turbine engine. A reduction in the leakage of working medium gases over the tips of the rotor blades is sought, and in one particular embodiment a goal is to limit the radial outward growth of an outer air seal circumscribing the tips of the rotor blades.

According to the present invention an outer air seal circumscribing the tips of the rotor blades of a rotary machine is supported radially by a continuous ring positioned externally of the machine case.

A primary feature of the present invention is the ring disposed externally of the machine case. Other features include the rods which extend radially inward from the ring and the outer air seal segments which are engaged by the rods. In one embodiment the rods engage corresponding blocks which are slideable within the seal segments.

The present invention has particular utility in stator constructions where isolation of the outer air seals from the machine case is desired. The diameter of the continuous ring establishes the radial position of the seal segments. The machine case expands and contracts without altering the radial position of the seal segments. The tendency of the machine case to pull the outer seal segments away from the circumscribed blade tips is avoided. Limiting the blade tip clearance at steady state conditions improves the aerodynamic efficiency of the machine as full interaction between the medium gases and the airfoil surfaces of the blades is achieved.

The foregoing, and other objects, features and advantages of the present invention will become more apparent in the light of the following detailed description of the preferred embodiment thereof as shown in the accompanying drawing.

BRIEF DESCRIPTION OF THE DRAWING

FIG. 1 is a cross section view taken through a portion of a gas turbine engine; and FIG. 2 is a sectional view taken along the line 2-2 as shown in FIG. 1.

DESCRIPTION OF THE PREFERRED EMBODIMENT

A gas turbine engine embodiment of the invention is shown in the drawing. The FIG. 1 simplified cross section view reveals a portion of the rotor assembly 10 including a plurality of rotor blades as represented by the single blade 12. Each blade 12 has a tip 14 at its radially outward extremity. A stator assembly 16, which principally comprising an engine case 18 and an outer air seal 20, houses the rotor assembly. The outer air seal has a cylindrical surface 22 which opposes the tips 14 of the rotor blades to prevent the leakage of working medium gases over the blade tips. The radial clearance between the tips of the rotor blades and the opposing cylindrical surface of the outer air seal is A.

As is illustrated in FIG. 2, the outer air seal is comprised of a plurality of arcuate segments 24 disposed in end to end relationship to circumscribe the tips 14 of the rotor blades. Each segment 24 has an outwardly opening circumferential track 26. The segments of the outer air seal are supported by radially extending rods or pins 28 which extend inwardly from an outer continuous ring 30. The pins penetrate the case 18 to engage a slideable block 32 disposed within a circumferentially extending track 26 of each arcuate segment. Two rods or pins 28 supporting each segment 24 are shown. More than two of such rods or pins may be utilized. A cylindrical bushing 34 at each case penetration supports the corresponding rod. A seal element, such as the piston ring seal 36, prevents the leakage of working medium gases from the interior of the engine case. The radial position of the seal segments 24 is dependent upon the diameter of the continuous ring 30, and is largely independent of the working medium temperature. Consequently, as the tips of the blades grow radially outward toward the seal, the seal diameter remains fixed. As thermal equilibrium is reached the seal diameter again remains fixed. The initial clearance at A need only be so large as will enable operation through transient conditions without destructive interference. Seal clearance at equilibrium conditions, such as cruise, is not excessive as the seal is prevented from growing away from the blade tips by the ring 30.

The case 18 moves freely between the seal 20 and the ring 30 in response to changes in the temperature of the medium flow path. The seal 36 prevents the leakage of working medium gases between each rod 28 and the corresponding bushing.

Apparatus constructed in accordance with the present invention enables the attainment of relatively small clearances at the cruise condition without the need for case cooling.

Although the invention has been shown and described with respect to preferred embodiments thereof it should be understood by those skilled in the art that various changes and omissions in the form and detail thereof may be made therein without departing from the spirit and the scope of the invention.

Having thus described typical embodiments of my invention, that which I claim as new and desire to secure by Letters Patent of the United States is:

1. For a gas turbine engine having an engine case, a segmented, outer air seal of the type adapted to circumscribe the tips of the rotor blades, wherein the improvement comprises:

a continuous ring positioned externally of the engine case for radially positioning the outer air seal, wherein said radial position is determined by a substantially fixed position of the continuous ring.

2. An outer air seal assembly of the type utilized to circumscribe the tips of the rotor blades of an axial flow rotary machine, wherein said seal assembly comprises:

a machine case having a plurality of circumferentially spaced bushings disposed therein;

a continuous ring positioned externally of the machine case and spaced radially apart therefrom;

a plurality of arcuate segments which circumscribe the tips of the rotor blades, and wherein each segment has a circumferential extending track;

two or more retention blocks slideably disposed within each circumferential track; and a plurality of pins extending radially inward from the continuous ring through said bushings to engage a corresponding block within the outer air seal.

3. The invention according to claim 2 wherein a sleeve disposed in the machine case is adapted to guide each of the radially extending pins.

4. The invention according to claim 3 wherein each sleeve further includes sealing means adapted to prevent the escape of working medium gases from the interior of the machine.

5. Means for supporting a segmented outer air seal of the type circumscribing the tips of rotor blades of a rotary machine, wherein said support means comprises;

an essentially cylindrical case enclosing the machine rotor and the outer air seal;

a continuous ring positioned externally of the engine case; and a plurality of rods attached to said ring and extending radially inward from said ring to engage the outer air seal.

6. The invention according to claim 5 wherein each of said seal segments is supported by at least two of said radially extending rods.

7. The invention according to claim 6 which further includes a cylindrical bushing supporting each rod at the engine case.

8. The invention according to claim 7 wherein said bushing has a cylindrical sealing surface and wherein each of said rods has a seal associated therewith to seal against the sealing surface of the corresponding bushing.

9. The invention according to claim 7 wherein each of said sealing segments has an arcuate track and wherein a slideable block is disposed in said track, each slideable block being engaged by one of said radially extending rods.

* * * * *